US006481471B1

(12) United States Patent
Johnson et al.

(10) Patent No.: US 6,481,471 B1
(45) Date of Patent: Nov. 19, 2002

(54) SPIKE ROLLER FOR AXIAL FEEDING OR ROTATION OF A LOG

(76) Inventors: Yvon Johnson, 69 Val d'Amour, P.O. Box 1120, Campbellton, New Brunswick (CA), E3N 3H4; Denis Johnson, 46 Aldrich Dr., P.O. Box 1014, Caribou, ME (US) 04736

( * ) Notice: Subject to any disclaimer, the term of this patent is extended or adjusted under 35 U.S.C. 154(b) by 0 days.

(21) Appl. No.: 09/579,566

(22) Filed: May 26, 2000

(30) Foreign Application Priority Data

Nov. 15, 1999 (CA) ..... 2290126

(51) Int. Cl.[7] ..... B27B 31/00

(52) U.S. Cl. ..... 144/246.1; 144/248.5; 144/248.7; 144/250.1; 198/780; 492/31; 492/36

(58) Field of Search ..... 144/242.1, 246.1, 144/248.5, 248.7, 248.3, 250.1; 198/624, 780, 782; 492/30, 31, 33–36, 38

(56) References Cited

U.S. PATENT DOCUMENTS 1,241,925 A * 10/1917 Coleman ..... 144/250.1
2,850,853 A * 9/1958 Simendinger ..... 492/36
3,812,561 A * 5/1974 Lundgren ..... 492/36
4,385,650 A * 5/1983 Schmidt ..... 144/248.7
4,510,981 A * 4/1985 Biller ..... 144/248.5
4,603,718 A 8/1986 Hutson ..... 144/208
4,721,139 A 1/1988 Peterson ..... 144/246 C
5,152,328 A * 10/1992 Arvidsson ..... 144/250.1
5,944,078 A 8/1999 Lindholm ..... 144/248

* cited by examiner

*Primary Examiner*—W Donald Bray
(74) *Attorney, Agent, or Firm*—McCormick, Paulding & Huber LLP

(57) ABSTRACT

A roller for grasping a log for axial movement or rotation of a log, the roller including spike bar retainers fastened on the cylindrical surface of the roller. The spike bar retainers accept and retain replaceable spike bars, thus facilitating replacement of worn spikes, which may be replaced without removal of the roller. The spike bars formed of alloy steel feature an improved type of spike having planar side surfaces that converge to a pointed end. The improved spikes grip and hold logs at lower average pressures over an extended period of use than conventional conical spikes.

14 Claims, 4 Drawing Sheets

SPIKE ROLLER FOR AXIAL FEEDING OR ROTATION OF A LOG

CROSS-REFERENCE TO RELATED APPLICATIONS

This is the first application filed for the present invention.

TECHNICAL FIELD

This invention is in the field of apparatus used to feed logs into the longitudinal centerline of apparatus such as debarkers. The invention relates to an improved method of mounting log engaging spikes on a log feeding roller. The invention also relates to an improved spike having upwardly inwardly inclined triangular faces to provide an improved grip on the logs engaged by the spikes of the roller.

BACKGROUND OF THE INVENTION

Conventional log feeding rollers are of two types, rollers having exterior ribs to engage the logs and rollers having exterior spikes to engage the logs. Log feeding rollers must engage and advance a log at a continuous rate through the longitudinal centerline of a device acting on the log. The log feeding rollers are connected to hydraulic cylinders which exert pressure tangentially on the log feeding roller to maintain and advance the log along the longitudinal centerline of the device acting on the log. The ribs or spikes on the exterior of the log feeding roller form the actual contact between the log feeding roller and the log. This invention relates to spike rollers as opposed to rollers having exterior ribs for engaging logs.

In conventional spike feed rollers, conical spikes are welded to the exterior of the cylindrical surface of the feed rollers. The spikes are welded to the exterior of the cylindrical surface of the feed roller in close enough proximity to one another that the cylindrical surface of roller supporting adjacent spikes is subject to heat when adjacent spikes are welded on to the exterior surface of the feed rollers. The heat may weaken the weld holding adjacent spikes on the exterior surface of the feed roller.

When the exterior spikes on a feed roller are worn, the roller is removed. Individual spikes are physically removed from the cylindrical surface of the feed roller and new conical spikes are welded to the external surface of the feed roller. The removal or worn conical spikes and replacement with new conical spikes on a roller takes many hours depending in part on the diameter and length of the feeding roller. Large spike rollers require lift equipment to remove the spike roller.

The conical spikes commonly welded to feed rollers are made of conventional steel suitable for welding to the surface of the feed roller. Conical spikes generally in use are not made of alloy heat treated steel because of the problems associated with welding alloy heat treated metals to the cylindrical surface of the log feed roller.

When conical spikes are worn and the logs are frozen it may become necessary to increase the tangential pressure applied to the log feeding rollers to support and advance the logs at a continuous rate. Increase in the tangential pressure applied to log feeding rollers may in the long run cause wear to the log feeding roller, the housings and to the logs being fed by the log feeding or exiting roller.

SUMMARY OF THE INVENTION

It is an object of the invention to provide an improved spike roller for feeding logs in which the spikes may be mounted on the exterior of the cylindrical spike roller and removed and replaced on the surface of the spike roller more quickly than conventional conical spikes. The spikes of the instant invention may be changed without removing the roller from position.

It is another object of the invention to provide an improved spike roller in which the spikes are made from alloy steel with exterior surface hardening applied after machining providing longer wear and less down time in replacing spikes on the spike roller engaging incoming and exiting logs.

It is another object of the invention to provide a spike having a machined exterior surface with upwardly inwardly inclined triangular faces meeting at a point providing improved gripping of the exterior of incoming and outgoing logs thus limiting the tangential pressure which must be exerted by the log feeding rollers to maintain the logs on the longitudinal centerline and advance the logs at a constant rate through the debarker or other apparatus.

It is another object of the invention to provide a spike which will hold the log against torque exerted by debarkers or other devices without substantial increase of the tangential pressure applied to the log.

According to one aspect of the invention there is provided a roller for feeding or removing logs axially along the longitudinal axis of an apparatus, the roller comprised of a cylindrical surface and two side surfaces, the axis of the roller extending through the centers of the side surfaces of the feeding roller, the cylindrical surface having a series of spike bar retainers fastened across the cylindrical surface parallel to the central axis of the roller.

According to another aspect of the invention there is provided a roller for feeding or removing logs axially along the longitudinal axis of an apparatus, the roller comprised of a cylindrical surface and two side surfaces, the axis of the roller extending through the centers of the side surfaces of the feeding roller, the cylindrical surface having a series of spike bar retainers fastened circumferentially around the cylindrical surface.

According to another aspect of the invention there is provided a spike retaining bar for mounting on the cylindrical surface of a spike roller for feeding or removing logs axially along the longitudinal axis of an apparatus adapted to receive and retain a spike bar having a series of spaced vertical spikes on the cylindrical surface of the roller.

According to another aspect of the invention there is provided a bar including a series of spaced apart vertical spikes for mounting in s spike retaining bar fastened to the cylindrical surface of a roller for feeding or removing logs axially along the longitudinal axis of an apparatus.

According to another aspect of the invention there is provided a roller for feeding or removing logs axially along the longitudinal axis of an apparatus, the roller comprised of a cylindrical surface and two side surfaces, the axis of the roller extending through the centers of the side surfaces of the feeding roller, the cylindrical surface having a series of spike bar retainers fastened in a helical arrangement around the circumference of the cylinder. The spike bar retainers are normally located on one side of the helical arrangement of one roller and on the opposite side of the helical arrangement of a complementary roller.

According to another aspect of the invention the spike bars and the spike bar retainers of this invention may be mounted on rollers used to rotate logs as well as on rollers used to advance logs axially.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

Figure 1:
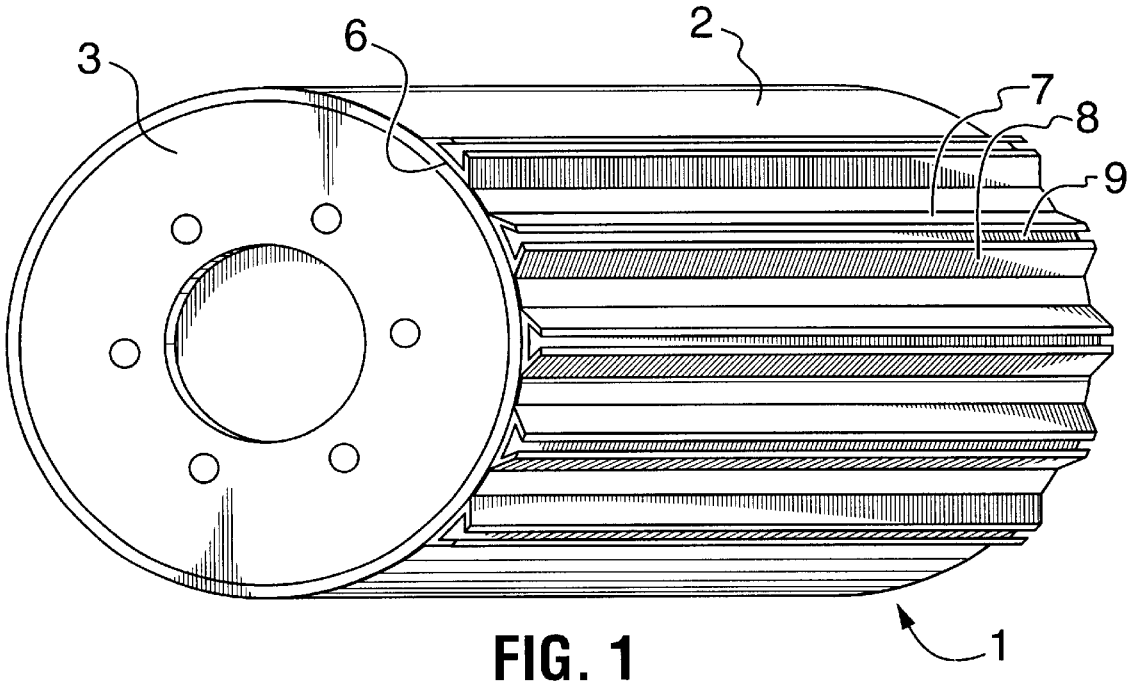
FIG. 1. is a perspective view of an inline spike roller having a cylindrical surface on which a series of inline spike bar retainers are fastened to the cylindrical surface parallel to the longitudinal axis of the inline spike roller for logs.

Referring to FIG. 1, there is shown a spike roller 1 used on conjunction with similar spike rollers to feed a log into and along the longitudinal centerline of a debarker or other apparatus and alternatively to pick up a log exiting a debarker. The spike roller 1 has a cylindrical surface 2 and ends 3 and 4. A series of inline spike bar retainers 5 are fastened to the cylindrical surface 2 parallel to the longitudinal centerline through spike roller 1. The inline spike bar retainers 5 have a retainer base 6 and retainer sides 7, 8 and spike bar retaining slot 9.

Figure 2:
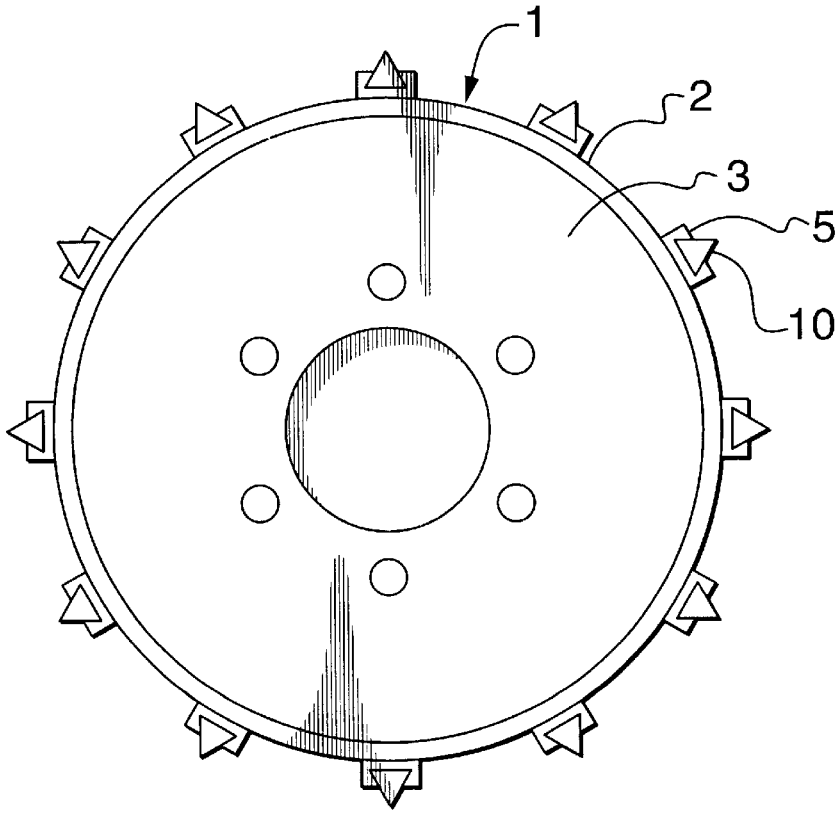
FIG. 2 is an end view of the inline spike roller for logs of FIG. 1 in which spike bars are located in the inline spike bar retainers.

Referring to FIG. 2, there is shown the end 3 of spike roller 1 with a series of inline spike bar retainers 5 fastened to the cylindrical surface 2 of log roller 1. Located within each of the inline spike bar retainers 5 are inline replaceable spike bars 10.

Figure 3:
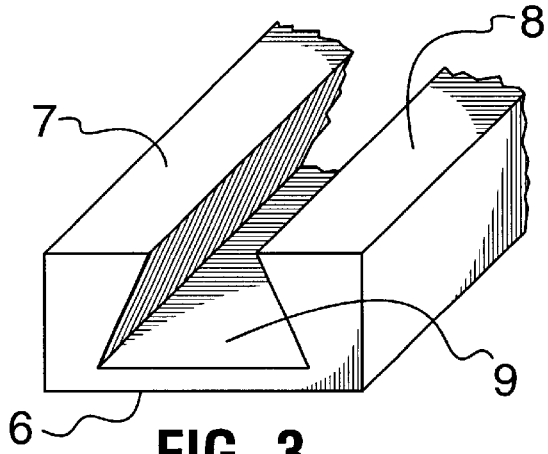
FIG. 3 is a perspective view from one end of an inline spike bar retainer.

Referring to FIG. 3 there is shown inline spike bar retainer 5 having a base 6, sides 7, 8 and spike bar retaining slot 9.

Figure 4:
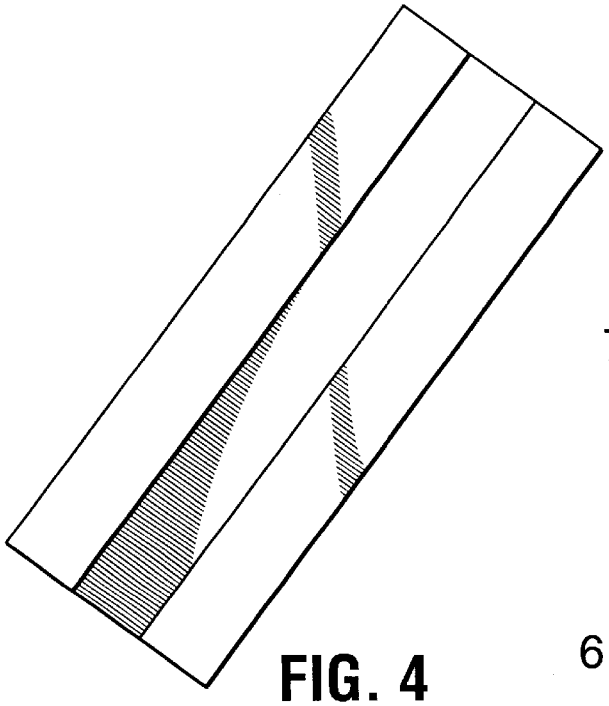
FIG. 4 is a top view of an inline spike bar retainer.

FIG. 4 shows the top of sides 7 and 8 and spike bar retaining slot 9.

Figure 5:
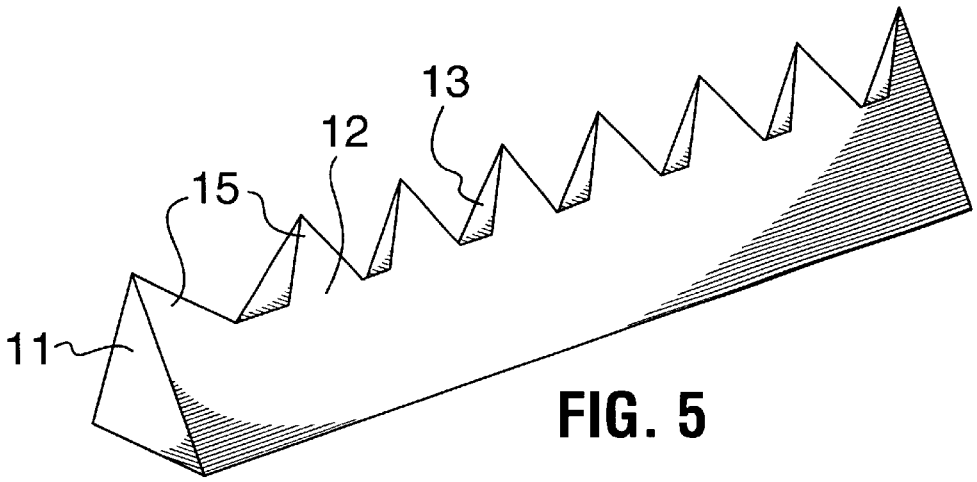
FIG. 5 is a perspective end view of one end of an inline spike bar.

FIG. 5 shows inline replaceable spike bar 10, having sides 11, 12, 13 and 14 and tips 15.

Figure 6:
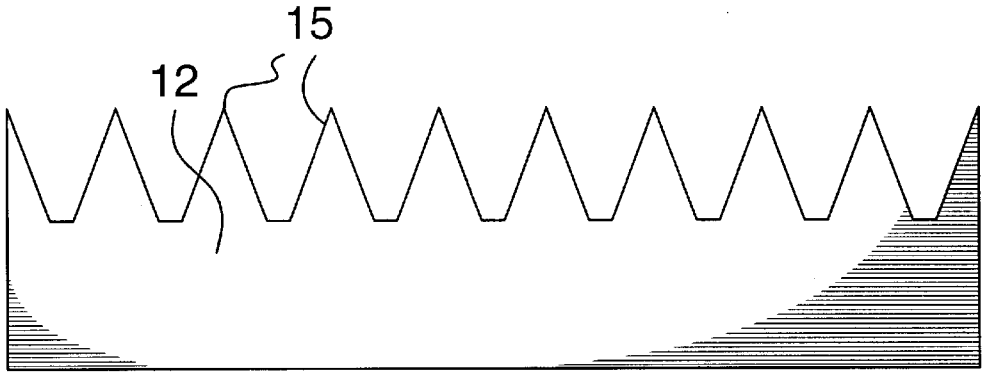
FIG. 6 is a side view of an inline spike bar.

FIG. 6 shows one side 12 of inline replaceable spike bar 10 and tips 15.

Figure 7:
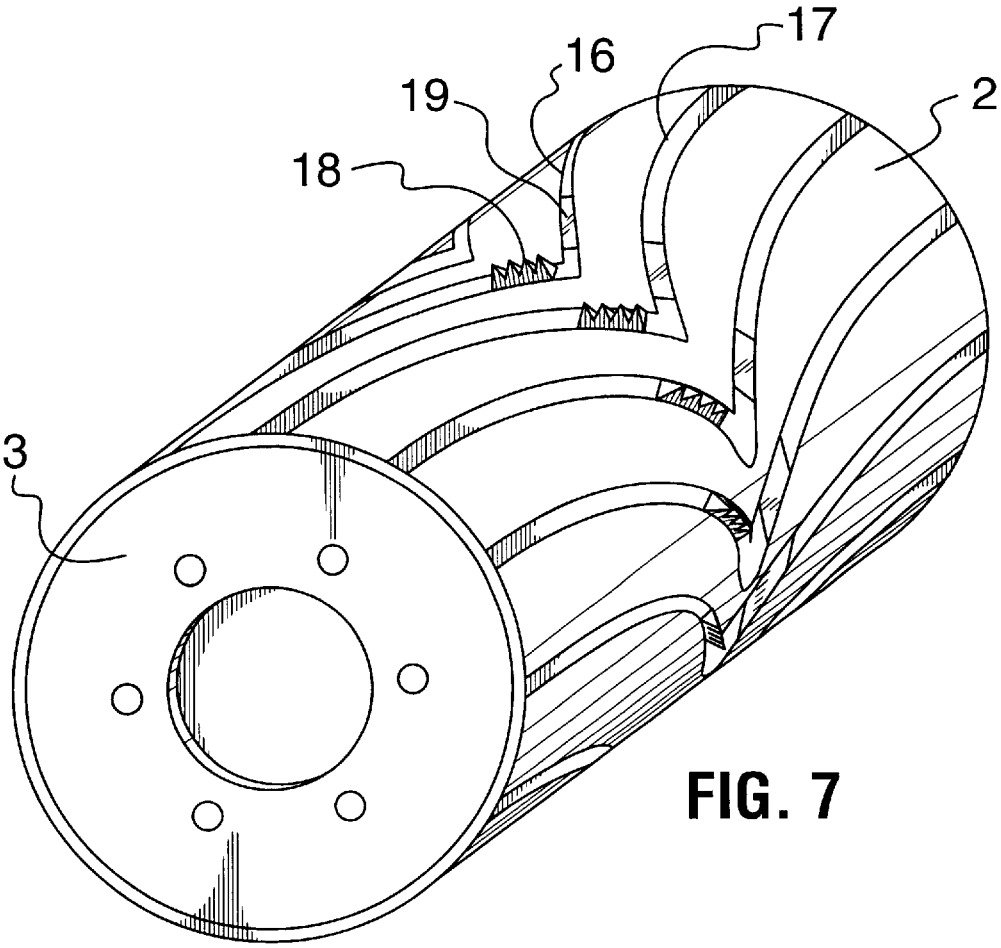
FIG. 7 is a perspective view of a helix spike roller for logs with a series of spike bar retainers arranged helically on the cylindrical surface with spike bars located in the spike bar retainers on one side of the helix and an interchangeable blank bar located in the spike bar retainers on the opposite side of the helix spike roller for logs.

FIG. 7 shows a spike roller 1, cylindrical surface 2 and ends 3, 4. Fastened to the surface are helical spike bar retainers 16 arranged helically on the cylindrical surface 2 of spike roller 1. The helical spike bar retainers 16 include a spike bar retaining slot 17. Helical spike rollers 1 normally contain helical spike bars 18 on only one side of the helical spike bar retainers 16.

Figure 8:
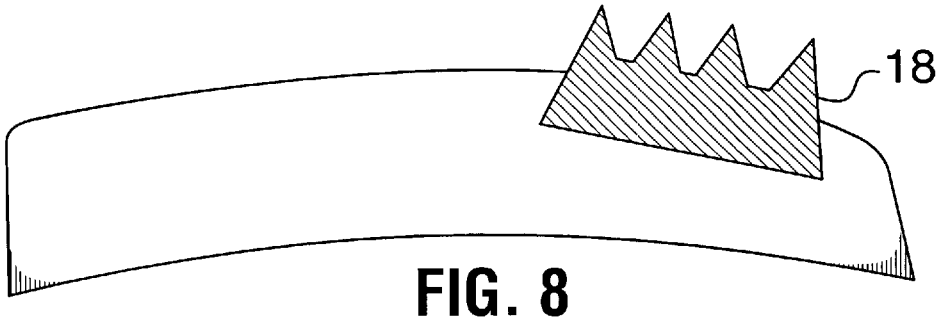
FIG. 8 is a side view of a spike bar for a helix spike roller.

FIG. 8 is a side view of replaceable helical spike bar 18 which is located and fastened on one side of helical spike bar retainer 17 as seen in FIG. 7. In a complementary spike roller 1, the replaceable helical spike bar is inserted in the spike bar retainer 16 on the opposite side of the helical arrangement.

Figure 9:
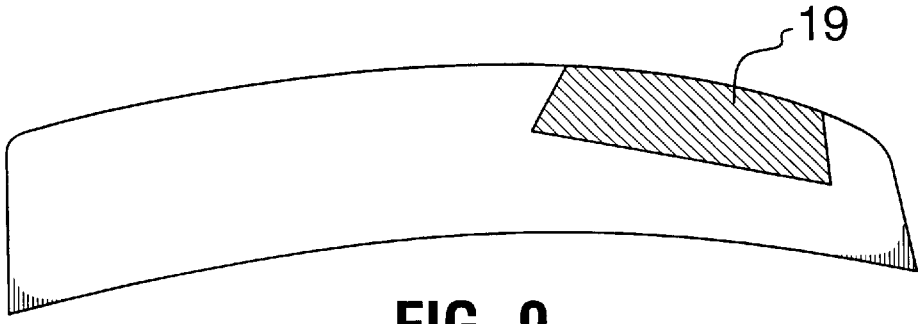
FIG. 9 is a side view of an interchangeable blank bar for use on one side of a helix spike roller.

FIG. 9 is a side view of a replaceable bar without spikes 19 which is located and fastened in the helical spike bar retainer 16 on the side opposite the helical spike bar retainers 16 containing spikes. The replaceable helical spike bars 18 or the replaceable helical bars without spikes 19 may be located in the helical spike bar retainers 16 on either side of the cylindrical surface as described on different spike roller 1 having helical spike bar retainers thereon.

Figure 10:
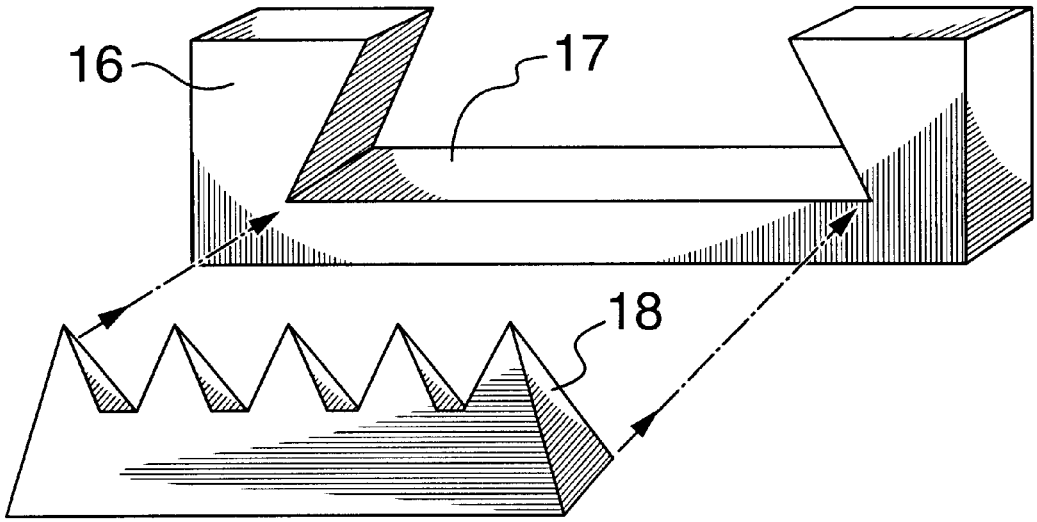
FIG. 10 is a perspective view showing how a spike bar is inserted into a helix spike bar holder.

FIG. 10 is a perspective view showing how a replaceable helical spike bar 18 is inserted into the retaining slot 17 of a helical spike for retainer 16.

Figure 11:
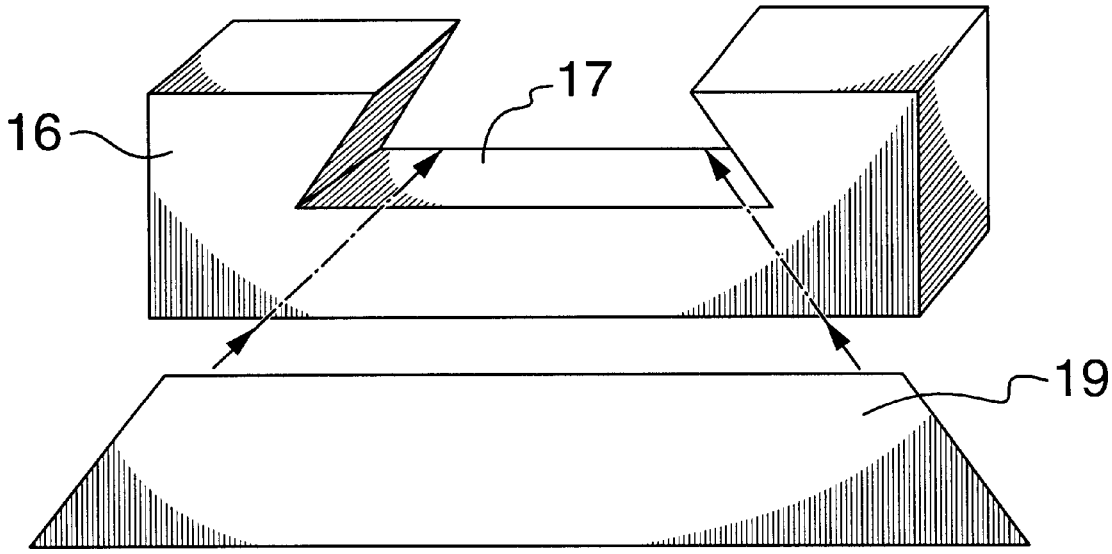
FIG. 11 is a perspective view showing how a blank bar without spikes is installed in a helix spike bar holder.

FIG. 11 is a perspective view showing how a replaceable helical bar without spikes is inserted in the retaining slot 17 of a helical ba r retainer 16.

In operation the inline spike bar retainer 5 or the helical spike bar retainer 16 are fastened to the surface of the cylindrical surface 2 of spike roller 1 as shown in FIGS. 1 and 7. Inline replaceable spike bar 10 is slid into the spike bar retaining slot 9 and the end of inline replaceable spike bar 10 is spot welded therein. When the spikes are worn the spot weld is removed and the replaceable spike bar 10 is slid out of the spike bar retaining slot 9 and a new replaceable spike bar 10 is pushed into the spike bar retaining slot 9 and spot welded into the retaining slot. The helical spike bar 18 and the helical bar without a spike 19 are slid into and removed from the helical spike bar retainer 16 in the same manner.

The spike bar retainer 5 and helical spike bar retainer 16 are machined from an easy machining medium low carbon steel. The inline replaceable spike bar 10 and the replaceable helical spike bar 18 are machined from bars of high hardness work-hardening alloy steel. The sides of the spikes are machined upwardly inwardly to a point and the alloyed steel is surface-hardened with tungsten carbide or similar surface hardeners in known fashion to provide longer wear of the spikes. The machined spikes provide superior performance in catching and supporting the logs than the conical tips or square spikes currently in use. Further, the use of high quality alloy steel in the inline replaceable spike bars 10 and replaceable helical spike bars 18 provides spikes which require less frequent change. When the spikes are worn and must be changed all that is required is the removal of the spot weld holding the inline replaceable spike bar 10 or helical spike bar 18 in their respective spike bar retainers, and removal of the worn spike bars therefrom and substitution of new spike bars therein.

The embodiments of the invention described above are intended to be exemplary only. The scope of the invention is therefore intended to be limited solely by the scope of the appended claims.

What is claimed is:

1. A roller for grasping a log for axial movement or rotation of the log, a) the roller comprised of a cylindrical surface and two side surfaces, b) the axis of the roller extending through the centers of the side surfaces of the roller the cylindrical surface having a series of spike bar retainers fastened across the cylindrical surface parallel to the central axis of the roller.

2. The roller of claim 1 in which a spike bar incorporating a series of spaced apart vertical spikes is fastened in each of the spike bar retainers.

3. A roller for grasping a log for axial movement or rotation of the log, a) the roller comprised of a cylindrical surface and two side surfaces, b) the axis of the roller extending through the centers of the side surfaces of the roller the cylindrical surface having a series of spike bar retainers fastened across the cylindrical surface parallel to the central axis of the roller; a spike bar incorporating a series of spaced apart vertical spikes fastened in each of the spike bar retainers; the vertical spikes on the spike bar are comprised of a number of inclined sides having planar surfaces.

4. The roller of claim 3 in which the vertical spikes on the spike bar have a pyramidal shape.

5. The roller of claim 3 or 4 in which the spike bar incorporating a series of spaced apart vertical spikes is machined from alloy steel.

6. A roller for grasping a log for axial movement or rotation of the log, a) the roller comprised of a cylindrical surface and two side surfaces, b) the axis of the roller extending through the centers of the side surfaces of the feeding roller, the cylindrical surface having a series of spike bar retainers fastened circumferentially around the cylindrical surface; spike bars incorporating a series of spaced apart vertical spikes are fastened in the spike bar retainers; the vertical spikes on the spike bar are comprised of a number of inclined sides having planar surfaces.

7. The roller of claim 6 in which the vertical spikes on the spike bar have a pyramidal shape.

8. The roller of claim 6 or 7 in which the spike bar incorporating a series of spaced apart vertical spikes is machined from alloy steel.

9. A spike retaining bar for mounting on the cylindrical surface of a roller for grasping a log for axial movement or rotation of the log, the spike retaining bar adapted to receive and retain a spike bar having a series of spaced vertical spikes, in which the retaining means is a partially enclosed slot in the spike retaining bar.

10. A spike bar for insertion in the spike retaining bar of claim 9, comprising a single piece of alloy steel bar having a base and a series of spaced spikes, each of said spikes having a plurality of inwardly upwardly sloping planar sides, each planar side of each spike having a triangular configuration, the tops of each planar side meeting at the tip of the respective spike.

11. A spike bar including a series of spaced apart vertical spikes for mounting in a spike retaining bar fastened to the cylindrical surface of a roller for grasping a log for axial movement or rotation of the log; in which the vertical spikes on the spike bar have a plurality of inwardly upwardly inclined sides having planar surfaces.

12. The spike bar of claim 11 incorporating a series of spaced apart vertical spikes in which the vertical spikes are pyramidal in shape.

13. The spike bar of claim 11 or 12 incorporating a series of spaced apart vertical spikes machined from alloy steel.

14. A roller for grasping a log for axial movement or rotation of the log, a) the roller comprised of a cylindrical surface and two side surfaces, b) the axis of the roller extending through the centers of the side surfaces of the roller, the cylindrical surface having a series of spaced spike bar retainers fastened in a helical arrangement on the circumference of the cylinder; a series of spaced spike bars are inserted and fastened in the helical arrangement of spike bar retainers on one side of the cylinder surface and a bar without spikes is fastened in the spike bar retainer arranged in a helical arrangement on the opposite side of the cylinder surface; the vertical spikes on the spike bar are comprised of a number of inclined sides having planar surfaces.

* * * * *